US007770746B2

(12) United States Patent
Aguirrezabal Oroz

(10) Patent No.: US 7,770,746 B2
(45) Date of Patent: Aug. 10, 2010

(54) TUBULAR CONTAINER COMPRISING TAMPER-PROOF LID

(75) Inventor: Antonio Aguirrezabal Oroz, Vitoria (ES)

(73) Assignee: Tuboplast Hispania, S.A., Minanó Mayor (Alava) (ES)

( * ) Notice: Subject to any disclaimer, the term of this patent is extended or adjusted under 35 U.S.C. 154(b) by 739 days.

(21) Appl. No.: 10/530,863

(22) PCT Filed: Oct. 10, 2002

(86) PCT No.: PCT/ES02/00477

§ 371 (c)(1),
(2), (4) Date: Nov. 29, 2005

(87) PCT Pub. No.: WO2004/033334

PCT Pub. Date: Apr. 22, 2004

(65) Prior Publication Data

US 2006/0091101 A1 May 4, 2006

(51) Int. Cl.
*B65D 41/16* (2006.01)
*B65D 41/04* (2006.01)

(52) U.S. Cl. ..... 215/330; 215/44; 215/321

(58) Field of Classification Search ..... 215/321, 215/44, 330, 252, 253; 222/519–521, 541.6, 222/548, 531, 532, 537, 554, 563
See application file for complete search history.

(56) References Cited

U.S. PATENT DOCUMENTS

| | | | | | |
|---|---|---|---|---|---|
| 3,010,619 | A | * | 11/1961 | Gronemeyer et al. | 222/521 |
| 4,867,354 | A | * | 9/1989 | Schreiber | 222/521 |
| 4,964,548 | A | * | 10/1990 | Kenyon, Jr. | 222/521 |
| 5,186,369 | A | * | 2/1993 | Aguirrezabal | 222/521 |
| 5,431,305 | A | * | 7/1995 | Kaminski | 222/109 |
| 5,505,346 | A | * | 4/1996 | Smith | 222/505 |
| 5,806,698 | A | * | 9/1998 | Aguirrezabal | 215/235 |

* cited by examiner

*Primary Examiner*—Robin Hylton
(74) *Attorney, Agent, or Firm*—Browdy and Neimark, PLLC

(57) ABSTRACT

A tubular container with a tamper-proof device (19) between the tube (1) and cap (2) and an assembly (14, 15) that creates a sound signal between both, in which the blind projection (24) on the tube is made in a smaller diametrical and longitudinal dimension and with the incorporation of an insert (13) that facilitates the manufacture and also the use of the container by the user.

6 Claims, 1 Drawing Sheet

TUBULAR CONTAINER COMPRISING TAMPER-PROOF LID

BACKGROUND OF THE INVENTION

1. Technical Field of the Invention

This invention relates to a tubular container with a tamper-proof cap, based on a container tube and a cap, on which the tube has an externally screw threaded hollow neck, onto which an internally screw threaded cylindrical portion of the cap fits.

In the interior of its hollow neck, the tube is provided with a portion of wall provide with holes to allow material to pass through, from the base of which and extending towards the exterior is a blind projection that continues to the open cavity in the central top surface of the cap, giving it access to the exterior so that the product contained in the tube can be applied or taken.

The cap has an outer skirt that closes over the tube, as well as an inner skirt which adjusts tightly against the internal wall of the screw threaded neck of the tube so as to make it leakproof and prevent the undesired exit of the product between both.

In the same way, the cap and tube are provided with the corresponding means to witness that the assembly is tamper-proof, as described in EP-A-0 410 922 belonging to the same applicant.

2. Prior Art

In equal conditions, and as suggested in EP-A-0 520 118, also belonging to the same applicant, the tube and cap have the corresponding means, a flexible projection on the tube and a rigid internal projection on the cap, which make contact when the cap is turned in one direction or the other, so that a characteristic noise is emitted.

In tubular containers of this kind, the blind projection that comes from the tube and adjust to the hole in the top surface of the cap is hollow and of a considerable diameter, and its free end is flat or slightly outwardly concave so that it can adjust to the usually concave shape of the said top surface of the cap.

The excessive diametrical dimension of the protuberance that forms the blind projection makes it necessary to use ingates of the appropriate dimensions in the injection process for this part and, as a result, prolonged cooling times which, in short, make both the procedure and the product more expensive.

Moreover, once the cooling period has passed, it is necessary to proceed and cut the free end of the blind projection created, which, in addition to meaning another operation, also includes the possibility of burrs appearing on the said projection.

As the result of all this, when the tube and cap unit is fully assembled, it is awkward to a certain extent for the user to use the product that comes out of the top surface of the cap.

A second disadvantage that also often occurs in practice is the lack of leak tightness between the surfaces of the inner skirt and the also internal surface of the neck of the tube, which, as they are flat, do not totally ensure that the product contained in the tube does not leak through this space accidentally.

On the other hand, in the said tubular containers, the sound warning between the cap and the tube is subject to certain limitations as regards intensity, due to the fact that the part that flexes is part of the tube itself, which on occasions leads to the limited generation of a sound signal.

OBJECT AND SUMMARY OF THE INVENTION

The object of the invention is to provide a tubular container that eliminates these disadvantages.

More specifically, the object of the invention is to provide a tubular container that increases performance by reducing the cooling times in the industrial process used in its manufacture.

Another object of the invention is to provide a tubular container from which the product reaches the exterior more easily and is more suitable for the user to use because it does not have burrs and, at the same time, favours the outward concavity of the top surface of the cap.

Another object of the invention is to provide a tubular container with a greater degree of leak tightness between the neck of the cap and its inner skirt.

And finally, another object of the invention is to provide a tubular container that obtains an increase in the strength of the sound signal emitted by it when the cap is turned in one direction or the other.

In order to put these objectives into practice, a blind projection is designed with a small diametrical dimension, for which ingates of smaller sizes are used, thus reducing cooling times in the injection process. The blind projection obtained in this manner does not require the adapting operation at its free end, since its length is less than that of the corresponding conventional part.

Over this blind projection, an open insert is placed, open at its lower end and closed at its other end, which has a spherical surface towards the exterior. The lower open end is provided with a circular lip, by means of which a seating is carried out on the holed wall of the internal base of the neck of the cap.

Preferably, at least one portion of the blind projection of the cap is provided with a longitudinal striation, by means of which a suitable seating is provided for the said insert on the said projection.

The insert is generally tapered in shape, although with a very slight taper, both in its interior and its exterior, and just below its upper spherical end, a trunco-conical chamfered area can be appreciated, on which the central cavity in the top surface of the is seated. The previously mentioned spherical end protrudes out to the exterior and has a better feel for users, who can apply their fingers in order to obtain the product contained in the tube.

The second objective of the invention is achieved by making at least one circular projection on the internal wall of the screw threaded neck of the cap in such a way that it ensures the continuous exacting contact that prevents any possibility of leaks in this area.

The third objective of the invention is achieved by altering the position of the flexible projection from the conventional position on the tube to its final position on the cap.

At the same time, the contact projection is transferred, from having been situated previously on the cap, to the tube, so that in this position the said projection will receive the action of the flexible projection now placed on the cap.

Given that the cap is hollow, the flexing of the projection with which it is now provided becomes louder in the opening and closing positions of the container, making it consequently more perceptible to the user.

BRIEF DESCRIPTION OF THE DRAWINGS

These and other details of the invention can be appreciated in greater detail by referring to the accompanying sheets of drawings which are enclosed by way of example, in which the following are represented.

DETAILED DESCRIPTION OF THE DRAWINGS

Figure 1:
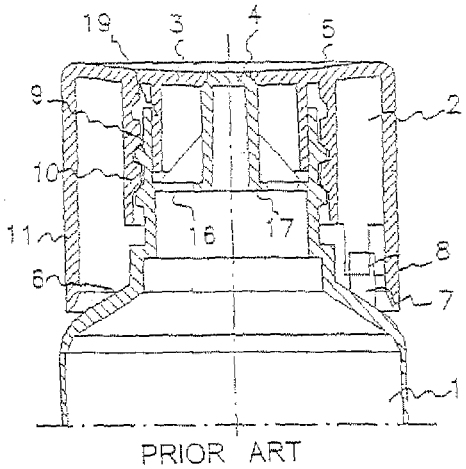
PRIOR ART Fig:1
FIG. 1 is a cross-section elevation of a conventional container provided with a tube and cap.

According to FIG. 1, we appreciate a container provided with a tube (1) and a cap (2). The tube (1) includes the externally screw-threaded neck (9) onto which the screw threaded portion of the inner skirt (10) is attached, as well as the outer skirt (11), both on the cap (2). A third skirt (19) is housed by pressure in the interior of the screw-threaded neck (9), and it is this adjustment that might give rise to unwanted leaks of the product that moves to this position from the tube (1), through the holes (16) in the wall (17) in the interior of the neck.

Over the upper tapered portion of the tube (1) it is possible to see the flexible projection (7) with which the portion (8) of the cap (2) makes contact.

The central part of FIG. 1 shows a blind hollow projection (4) or protuberance, with an internal cavity of a certain diametrical dimension. The upper end of the projection (4) is cut to adapt to the concavity of the top surface (3) of the cap. It can be appreciated here how the concavity of this top surface (3) of the cap is very limited as a result of the flat surface at the end of the central projection, which reduces the range of several concavities that a specific container might have.

In FIG. 1, the tamper-proof stop area of the cap suggested by EP-A-0 410 922 and EP-A-0 520 118 has not been shown.

Figure 2:
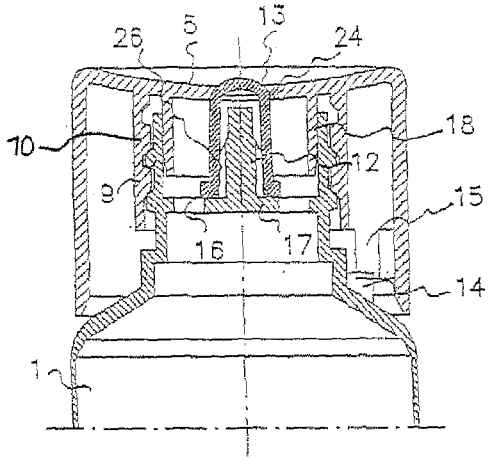
FIG. 2 shows a cross-section elevation of a container in accordance with the invention.

The configuration of the projection according to the invention is shown in FIG. 2. The invention features a solid projection (12) which is provided with some longitudinal notches in order to engage the hollow insert (13). The height of the solid projection (12) is less than that of a conventional one and is complemented to the necessary amount by the said hollow insert until reaches the cavity in the cap.

Due to the end of the hollow insert (13) being spherical, the user always finds an area which is pleasant to touch and also makes it possible to provide the top surface (5) of the cap (2) with the concavity desired. In this respect, the difference of these concavities can be appreciated between the conventional container in FIG. 1 and those carried out in accordance with the invention, shown in FIGS. 2 and 3.

In the same FIG. 2, we can point out the position of the fixed ledge (14) of the tube (1) and how, from the interior of the cap (2), the flexible tongue (15) is responsible for flexing on the said fixed ledge (14) so as to more effectively make a sound.

In FIG. 2, the internal side of the screw-threaded neck (9) of the cap is provided with an annular ledge (23) for leak tightness.

Figure 3:
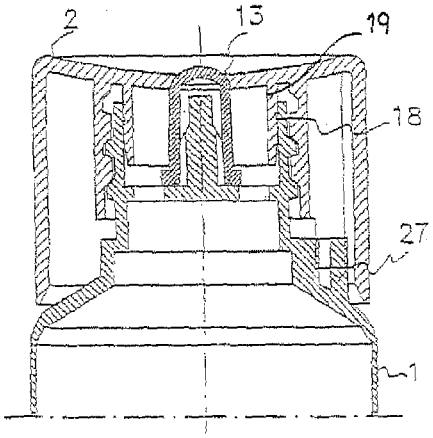
FIG. 3 is another cross-section elevation of the container shown in FIG. 2.

The detail of the tamper-proof area that the cap is provided with, in accordance with the above technique, is defined in the view of FIG. 3 at position (19), at which the positioning of the combined auxiliary elements of the tube and of the cap is carried out.

Figure 4:
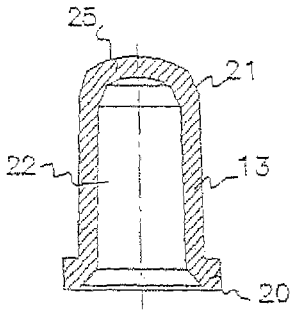
FIG. 4 is a cross-section elevation of the insert in accordance with the invention.

The configuration of the hollow insert (13) of the invention is shown in greater detail in FIG. 4. The insert (13) is slightly tapered, with its open lower base on which the annular outer ledge (20) can be appreciated, so that it can be seated in the holed wall (17) in the interior of the tube neck. The solid projection (12) is received in the hollow insert internal cavity (22) and its upper end is shaped as a spherical area (25), which is the part the user can touch. Below the spherical area (25) is the conical portion (21) to be seated in the corresponding hole (24), made in the thickness of the top surface (5) of the cap (2).

Figure 5:
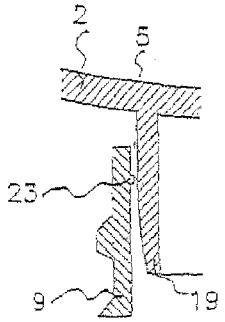
FIG. 5 represents a detail of the leaktight connection between the tube and the cap.

In FIG. 5, we can point out the detail of the internal wall of the screw-threaded neck (9) of the tube (1), on which the annular ledge (23) is located, on which the inner skirt (19) of the cap (2) is supported, in order to totally ensure the leak tightness between both in any position that the cap might occupy.

As stated previously, a single annular ledge (23) has been represented here, although it must be understood that there might be two or even more of these ledges, arranged on the internal surface of the screw-threaded neck (9) at positions that practice advises.

Obviously, the annular ledge or ledges (23), although preferably made on the screw-threaded neck (9) of the tube (1), can instead be made on the inner skirt (19) of the cap (2), which is recorded here for the appropriate purposes.

The invention claimed is:

1. A tubular container comprising a tube (1) and a cap (2), the cap (2) being provided with a hole (24) in the centre of its outer top surface (5), wherein the tube (1) has an externally screw-threaded neck (9) on which an internally screw-threaded inner skirt (10) of the cap (2) is engaged, a horizontal wall (17) within the neck (9), the horizontal wall (17) being provided with holes (16) so that a product can pass through the holes (16) from the inside of the tube (1) towards the hole (24) in the cap (2);

wherein the cap (2) also has a second inner skirt (19), a solid projection (12) fixed to and extending upwardly from the horizontal wall (17) of the tube (1);

a hollow insert (13) open at one end, comprising an annular outer ledge (20) by which the hollow insert (13) is seated on the wall (17), the hollow insert (13) defining an internal cavity (22) having a diameter larger than the solid projection (12) to receive therewithin the solid projection (12), and the hollow insert (13) comprising an upper end finishing off in a spherical area (25) that protrudes through the hole (24) in the top surface (5) of the cap (2), wherein the solid projection (12) has a height which does not reach the outer top surface (5) of the cap;

at least one annular ledge (23) on the inner side of the screw-threaded neck (9) against which the second inner skirt (19) of the cap is engaged and adjusted, and a flexible tongue (15) on the interior of the cap (2), which makes contact and flexes, during the turning of the cap (2), with a fixed ledge (14) made on the tube.

2. The container of claim 1, wherein the flexible tongue (15) on the interior of the cap (2) is fixed on the inner skirt (10) projecting inwardly, and the fixed ledge (14) on the tube is at a level of the flexible tongue (15) and extends outwardly to contact the flexible tongue (15) when the cap (2) is turned.

3. A tubular container with a tamper-proof device, the container comprising a tube (1) and a cap (2), wherein the tube (1) comprises a screw-threaded neck (9) inside of which there is a horizontal wall (17) provided with holes (16) so that a product can pass from the inside of the tube (1), wherein the cap (2) comprises an outer top surface (5) provided with a hole (24) in its centre through which the product coming from the inside of the tube (1) can pass, a screw-threaded inner skirt (10) and a second inner skirt (19) which respectively engage outwardly and inwardly with the screw-threaded neck (9) of the tube (1), wherein the tube (1) further comprises a solid projection (12) fixed to and extending upwardly from the horizontal wall (17), said solid projection (12) not reaching the outer top surface (5) of the cap (2), a hollow insert (13) which fits on the solid projection (12), said hollow insert (13) being open at one end and comprising an annular outer ledge (20) by which said hollow insert (13) is seated on the wall (17), said hollow insert (13) comprising an internal cavity (22) to receive the solid projection (12), and an upper end finishing off in a spherical area (25) that protrudes through the hole (24) in the top surface (5) of the cap (2), at least one annular ledge (23) made on the inner side of the screw-threaded neck (9) against which the second inner skirt (19) of the cap is engaged and adjusted, a flexible tongue (15) made in the interior of the cap (2), which makes contact and flexes, during the turning of the cap (2), with a fixed ledge (14) made on the tube.

4. The tubular container with a tamper-proof device, in accordance with claim 3, wherein the solid projection (12) is at least partially provided with some longitudinal ledges (26).

5. The tubular container with a tamper-proof device, in accordance with claim 3, wherein the hollow insert (13) is slightly tapered in shape, both in its interior and exterior, and on the exterior it has a conical portion (21), below the spherical area (25), which correspondingly fits into the hole (24) in the top surface (3) of the cap (2).

6. The tubular container with a tamper-proof device, in accordance with claim 3, wherein the at least one annular ledge (23) is provided on the side of the second inner skirt (19) of the cap (2) to be engaged against said screw-threaded neck (9).

* * * * *